United States Patent [19]

Ackley, Sr. et al.

[11] 4,189,996

[45] Feb. 26, 1980

[54] CONVEYOR LINK AND CAPSULE GUIDE FOR PRINTERS

[75] Inventors: Charles E. Ackley, Sr., Oreland; Charles E. Ackley, Jr., Philadelphia, both of Pa.

[73] Assignee: R.W. Hartnett Company, Philadelphia, Pa.

[21] Appl. No.: 859,303

[22] Filed: Dec. 12, 1977

[51] Int. Cl.[2] ..... B41F 17/36

[52] U.S. Cl. ..... 101/37; 101/40; 198/655

[58] Field of Search ..... 101/36–40; 198/655

[56] References Cited

U.S. PATENT DOCUMENTS

| | | | |
|---|---|---|---|
| 2,931,292 | 4/1960 | Ackley | 101/37 |
| 3,042,183 | 7/1962 | Ackley | 198/392 |
| 3,272,118 | 9/1966 | Ackley | 101/37 |
| 3,850,096 | 11/1974 | Taniguchi | 101/40 |
| 3,884,143 | 5/1975 | Ackley | 101/37 |
| 3,931,884 | 1/1976 | Ackley | 101/40 X |

*Primary Examiner*—Clifford D. Crowder
*Attorney, Agent, or Firm*—Miller & Prestia

[57] ABSTRACT

In an apparatus adapted to transport and imprint indicia around the circumference or portions thereof, of generally cylindrical objects, such as capsules, an improved object carrying device and capsule guide are disclosed that facilitate non-smear processing and easy ejection of the capsules from the device after printing. The capsule guide and carrier are provided with corresponding relief portions formed therein so that indicia imprinted on the capsules are not smeared as the objects are spun about their axes during printing. The capsule carrier includes a pocket to receive and transport the capsules along a predetermined path. The pocket is defined by a pair of opposed wall members that may be bevelled to facilitate easy ejection of the capsules from the carrier printing. Also, for imprinting upon one or both sides of tablets, pills, and the like, a pair of grooved capsule guides are disposed along opposed sides of the transport device. The grooves are aligned with each other and disposed in facing relationship to provide a track upon which the respective sides of the object are transported by the carrier. Window means are provided in at least one guide bar through which a print roll extends to imprint the desired indicia on the object side.

5 Claims, 12 Drawing Figures

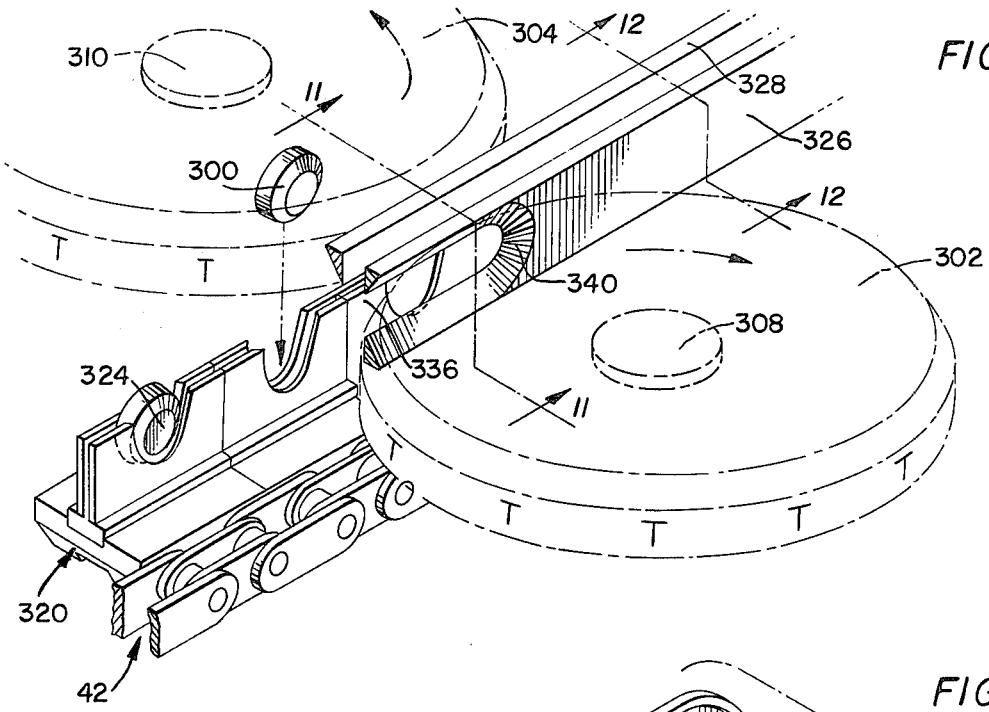
FIG. 9.
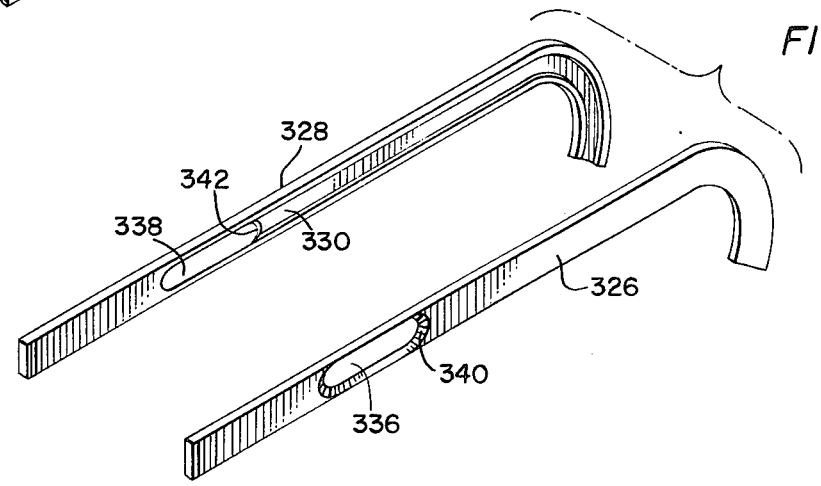
FIG. 10.
FIG. 11.
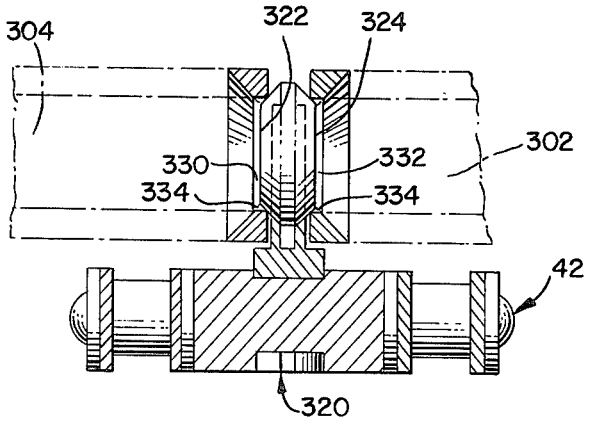
FIG. 12.
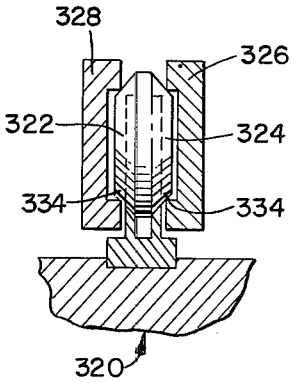

CONVEYOR LINK AND CAPSULE GUIDE FOR PRINTERS

BACKGROUND OF THE INVENTION

This invention relates generally to machines adapted to transport and print around the circumference of small, generally cylindrically shaped objects, such as pharmaceutical capsules. Further disclosed are dual guide means used in conjunction with machines adapted to print on one or both sides of an object such as a tablet, pill or the like.

For some time the pharmaceutical and other industries have been applying the manufacturers' trademarks or other indicia or inscriptions to their products. These indicia not only serve to identify the source of the products but can also be printed so finely and so distinctly directly upon the articles as to render counterfeiting difficult or virtually impossible.

This invention is directed toward apparatus that is adapted to transport generally cylindrical shaped objects and to print around their circumference or portions thereof. In the art, this process is often referred to as "wrap around" printing wherein the object is spun about its longitudinal axis during printing. Also, a novel object guide for use with printers adapted to imprint certain indicia on the generally planar sides of pills, tablets, etc. is provided.

The prior patent to Charles E. Ackley, U.S. Pat. No. 3,272,118 discloses an apparatus that can be suitably adapted to perform "wrap around" printing on capsules and the like at relatively high production rates. However, sometimes the indicia printed on the capsules are smeared during transportation of the printed capsules along the conveyor after printing but prior to ejection. Also, the capsules are somewhat difficult to dislodge from their respective carriers during the ejection step due to the resilient nature of the capsule receiving pocket portion of the carrier. These factors result in reduced acceptable output and increased machine down time.

Accordingly, it is an object of the present invention to provide capsule carrying devices and guides for use in "wrap around" printers that significantly minimize the risk of smearing of the desired indicia as the objects are processed on the apparatus.

It is a further object of the present invention to provide for increased apparatus efficiency with respect to capsule ejection from the apparatus after printing.

It is another object of the invention to provide improved object guides for use in machines designed to imprint along one or both sides of pills, tablets, etc.

SUMMARY OF THE INVENTION

These and other objects are met by the present invention. Basically, the novel object carrier and guides herein disclosed can be used in conjunction with any apparatus that includes a conveyor for carrying the generally cylindrical objects in single file along a predetermined path past a "wrap around" printing station. However, the object carriers and guides herein disclosed are particularly well suited for use in conjunction with the printer apparatus disclosed in the aforesaid U.S. Pat. No. 3,272,118 (of common assignment herewith).

The carrier members are carried by the conveyor and include pocket means arranged to receive the cylindrically shaped objects to be printed from a hopper or the like. The apparatus further comprises "wrap around" printing means including a guide cooperating with a print roll to imparting the desired indicia about the longitudinal axis of the object. As is well known in the art, in "wrap around" printing, the surface speed of the printing roll must be driven in excess of the linear speed of the conveyor so that the objects are rotated about their respective axes during printing. Means for ejecting the objects from the apparatus are provided at a location downstream from the printing station.

In accordance with the present invention, the object carrier pocket is provided with a recessed relief portion extending about the interior portion of the pocket so that indicia imprinted on the object in the area proximate the relief area are not smeared during printing.

Also, if desired, the guide may comprise a recessed portion that is aligned with the pocket relief portion and extends in the transport direction of the conveyor, thus indicia printed on the objects are not contacted by any surface during spinning. This insures substantially smear-free processing of capsules during the "wrap around" printing operation.

In non "wrap around" printing applications wherein it is desired to print along the generally planar side surface or surfaces of a tablet or the like, a pair of grooved guides are disposed on opposite sides of the conveyor with the grooves in facing, aligned relation to form a track upon which the respective sides of the tablet are transported by the carrier. Window means are provided in at least one of the guides so that a printing roll can extend therethrough to contact and print upon the desired side of the tablet. If it is desired to print upon both tablet or pill sides, both guides are provided with window means, and print rolls disposed on opposed sides of the conveyor extend through the windows to print on both sides of the tablet.

The foregoing will be further explained in conjunction with the following detailed description and drawings, which show and describe one specific form of the invention, and which are not intended to limit the scope of the invention, which is defined in the appended claims.

BRIEF DESCRIPTION OF THE DRAWINGS

In the drawings,

FIG. 9 is a perspective view of an alternative form adapted for printing of tablets, including a dual guide, tablet carriers, and printing means adapted to imprint along both sides of each tablet;

FIG. 10 is an exploded perspective view of the tablet guides shown in FIG. 9;

FIG. 11 is a fragmentary sectional view taken as indicated by the lines 11—11 which appear in FIG. 9; and FIG. 12 is a fragmentary sectional view taken as indicated by the lines 12—12 which appear in FIG. 9.

DETAILED DESCRIPTION OF A PREFERRED EMBODIMENT

Figure 1:
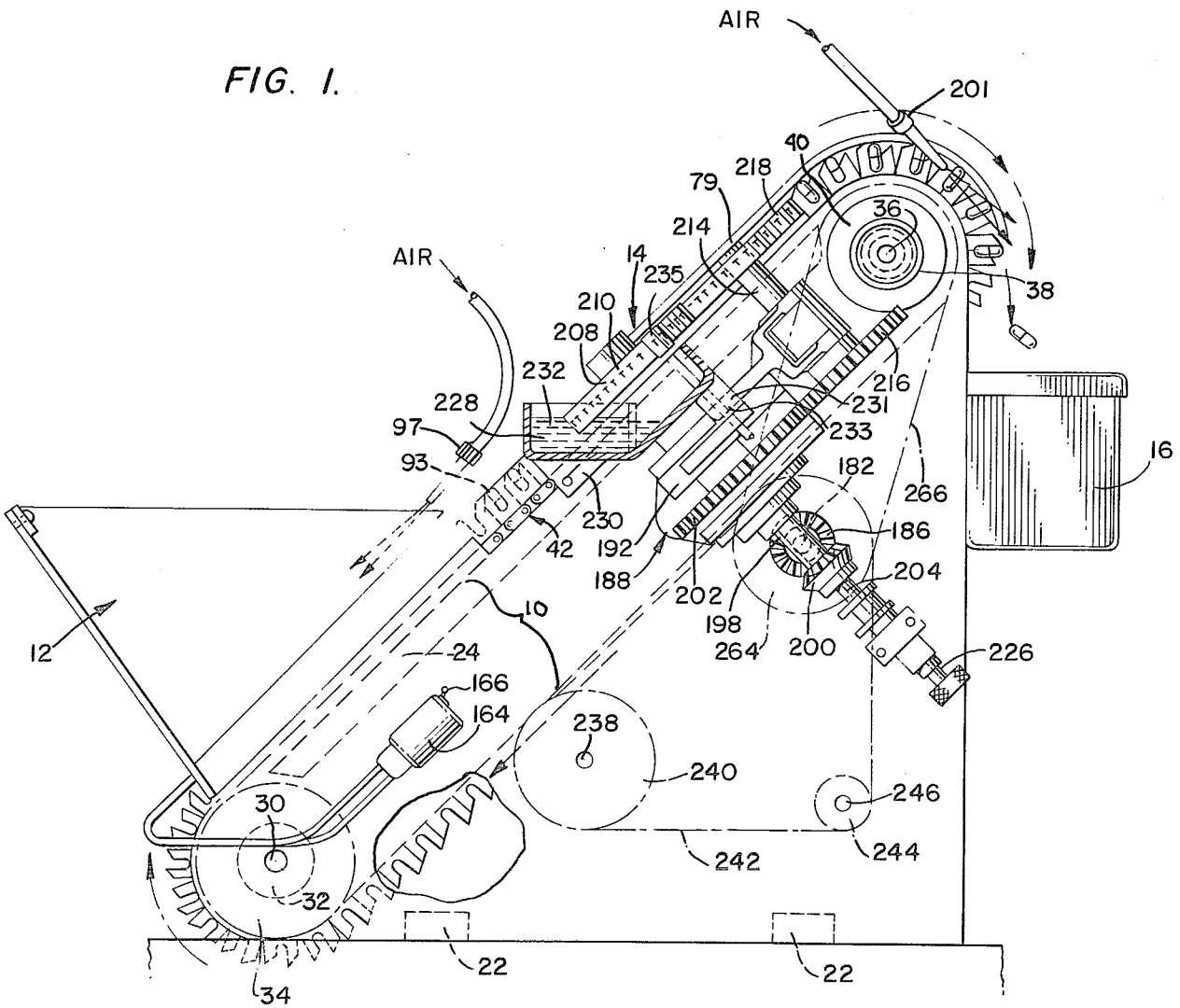
FIG. 1 is a side elevation of one specific form of apparatus embodying features of this invention and adapted for "wrap around" printing, certain parts being broken away to better illustrate the invention.

The following description is directed specifically to the forms of the invention illustrated in the drawings and is not intended to limit the scope of the invention, which is defined in the appended claims.

FIGS. 1 through 8 of the drawings depict the "wrap around" print embodiments chosen for illustrations, whereas FIGS. 9 through 12 show adaptions suitable for printing along one or both sides of a tablet, pill, or the like.

With reference to FIG. 1, the machine selected for illustration in the drawings includes an inclined conveyor 10 having a feed hopper 12, and mounting marking or printing mechanism, generally designated 14.

Figure 2:
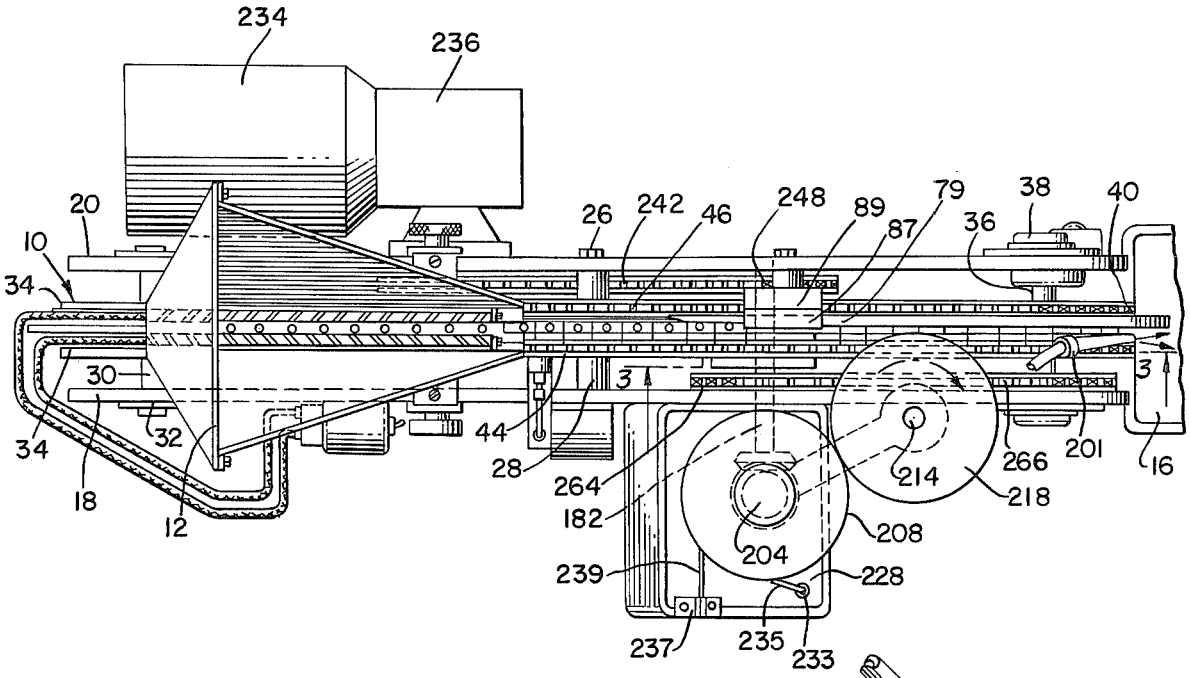
FIG. 2 is a plan view of the apparatus shown in FIG. 1.
Figure 3:
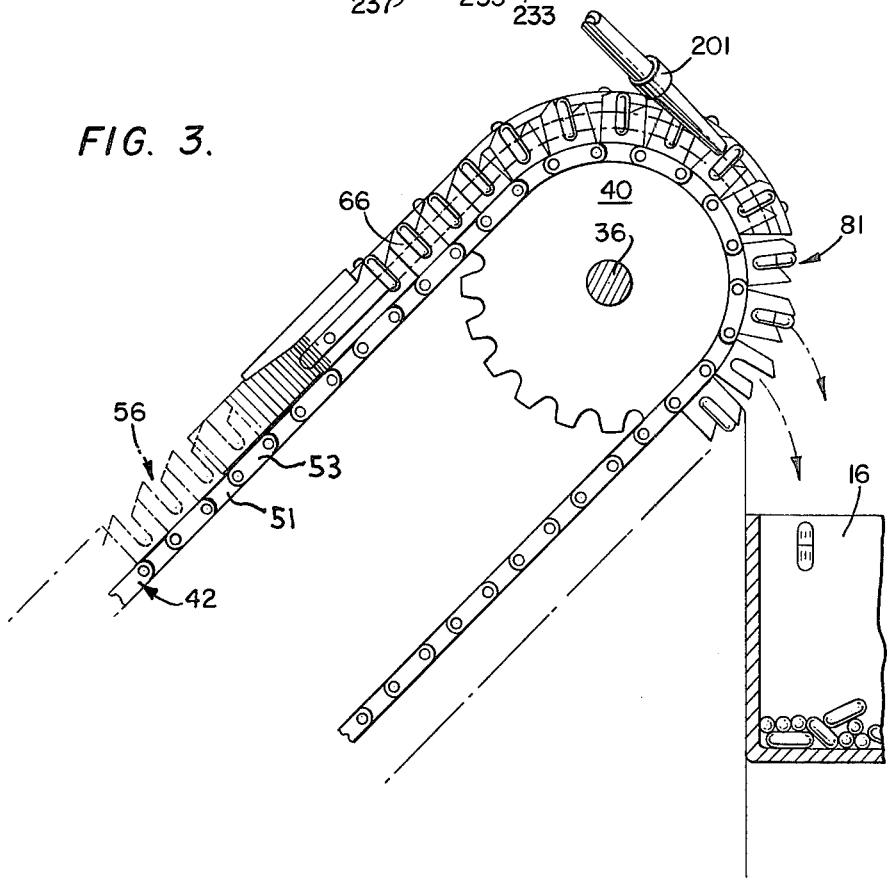
FIG. 3 is a detailed enlarged sectional view, taken as indicated by the lines 3—3 which appear in FIG. 2, showing the cooperation between the capsule guide and carrier.

Referring particularly to FIGS. 1 through 3, the conveyor 10 comprises a rigid framework having two laterally spaced upright side frames 18 and 12 (FIG. 2). The side frames 18, 20 are held apart at the base of the machine by a pair of spacers, designated 22, (FIG. 1). Disposed between inclined marginal areas of the side frames is a runner bar 24, (FIG. 1) and extending through the side frames and the runner bar 24 are a plurality of bolts 26. Fitted over each bolt 26 and disposed between each side frame and the runner 24 is a tubular spacer 28.

At the foot of the conveyor is a shaft 30 journaled in a pair of bearings 32 carried respectively by the side frames 18 and 20. The shaft 30 carries a pair of axially spaced sprockets 34. At the head of the conveyor is a shaft 36 journaled in a pair of bearings 38 carried respectively by the side frames 18 and 20. The shaft 36 carries a pair of axially spaced sprockets 40.

Figure 5:
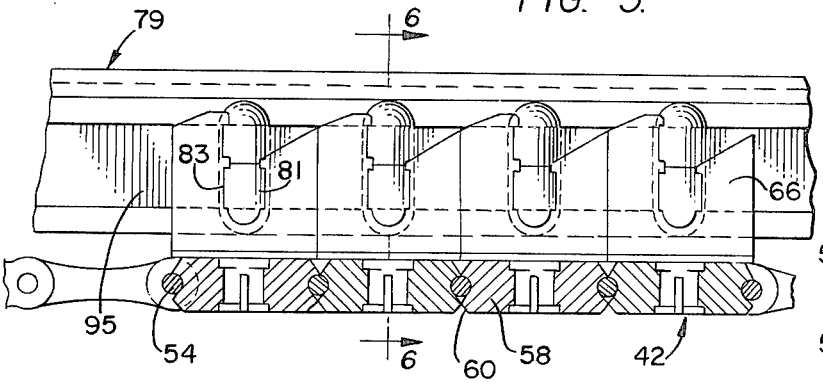
FIG. 5 is a cutaway side view of the capsule guide, chain blocks and capsule carriers adapted for "wrap around" printing.

The conveyor comprises an endless belt, generally designated 42 (see FIGS. 1, 3, 5 and 6) including a pair of articulated chains 44 and 46 each trained over one of the sprockets 34 and one of the sprockets 40. The upper and lower runs of the endless belt 42 are parallel and inclined at approximately 35 to 55 degrees. The upper run of the endless belt 42 rests upon the runner bar 24, as best shown in FIG. 1. Alternate links 51 of each chain include a pair of inner bars 48, and intervening links 53 of each chain include a pair of outer bars 50. Between each pair of inner bars 48 are a pair of spacers 52, and extending through each spacer 52 and the associated links 51 is a pin 54 (FIG. 5).

Figure 6:
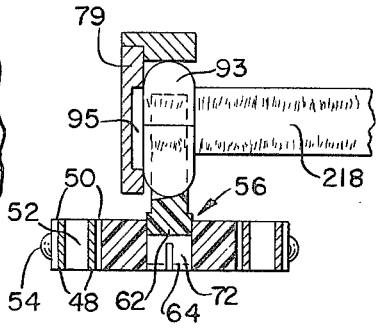
FIG. 6 is a sectional view taken as indicated by the lines 6—6 which appear in FIG. 5.
Figure 7:
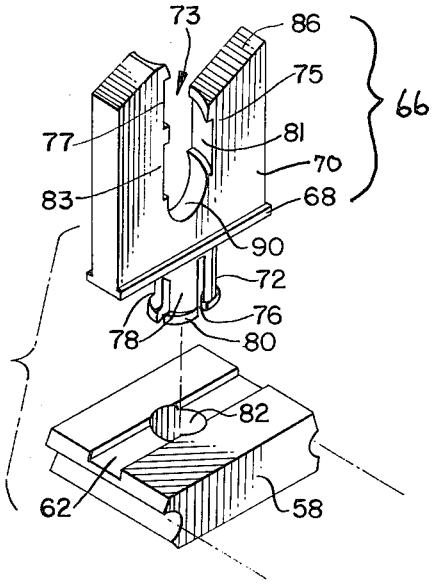
FIG. 7 is an exploded perspective view of the chain block and capsule carrier comprising a component of the apparatus shown in FIGS. 1-3 of the drawings.
Figure 8:
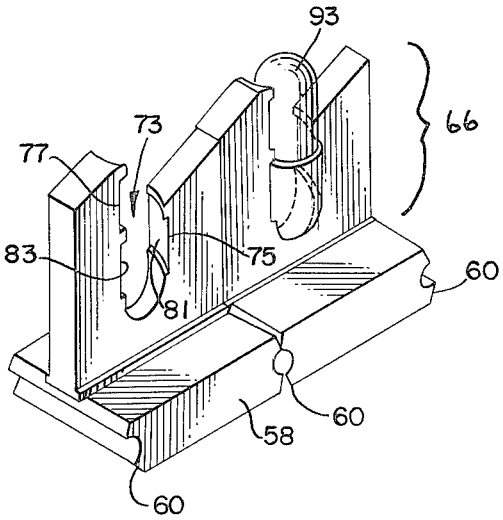
FIG. 8 is a perspective view showing the capsule holders and chain blocks of FIG. 7 in assembled form.

Associated with the links 51, 53 respectively of the chains 44 and 46 is an object carrier, generally designated 56 (FIG. 6). Each carrier 56 includes a base member 58 (FIG. 5) beveled at both ends, as at 60, and provided at the top and bottom respectively with longitudinally extending grooves 62 and 64. The pins 54 extend through the base members 58, as shown. Each base member 58 accommodates a holder member 66 (FIGS. 3, 7) made of plastic material and provided with a longitudinally extending base part 68 integral with a main body part 70 and seated in the groove 62. Depending from the base part 68 is a yieldable release member or protuberance 72 having cross slits, as at 76, to provide four flexible fingers 78, each terminating in a laterally extending flange 80. The protuberance 72 projects downwardly through a tapered opening 82 formed in the base member 58 and snaps under the base of the groove 64.

Referring particularly to FIGS. 5 through 8, the carrier 66 is provided with a pocket portion 73 and a downwardly and rearwardly extending feed surface 86. The pocket 73 is defined by vertically extending walls 75, 77 and has a rounded bottom 90. The surface 86 is flat, but the walls 75, 77 are beveled to facilitate ejection of object 93 after it has been printed. As seen for example in FIG. 7, the opening between the beveled walls which faces the guide 79 is larger than the opening on the opposite side of the beveled walls. When the carrier 66 is on the upper run of the endless belt, the surface 86 is upright. The diameter of the object 93 is greater than the thickness of the main body 70, in consequence of which the opposite sides of the object 93 extend beyond the sides of body 70.

Further, in relation to FIGS. 3 through 8, the carrier is provided with recesses 81, 83, formed in walls 75, 77 and it can be seen that the recesses 81, 83 extend around the pocket 73. The recesses 81, 83 are oppositely disposed from each other and together form a relief area that insures that indicia printed on the object do not smear as the object is rotated about its axis and transported along the conveyor downstream from the printing station.

Figure 4:
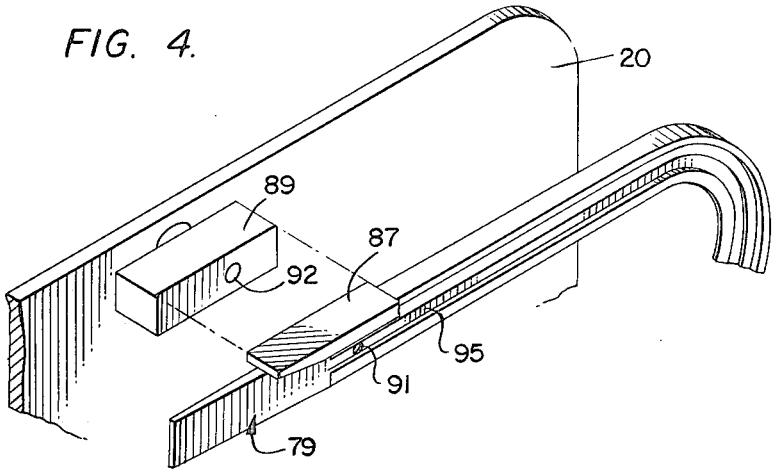
FIG. 4 is an exploded perspective view of the capsule guide comprising a portion of the apparatus of FIG. 1, showing the manner of attachment of said guide to the apparatus housing.

As best seen in FIG. 4, the guide 79 is attached to side frame member 20 by connection of spacer bar 87 to positioning block 89 that is secured to the frame 20. Bolts or the like are inserted through mating apertures 91, 92 to securely position the guide 79 alongside the conveyor opposite the print roll 218 (FIGS. 1 and 2). Guide 79 is also formed with a recessed area 95 that extends in the conveyor transport direction. The guide recess 95 is aligned with recesses 81, 83 formed in the walls 75, 77 so that the portion of the object 93 proximate recesses 81, 83 and 95 is completely free of contact with surfaces that would otherwise tend to smear indicia printed thereon.

The hopper 12 is secured to the mechanism as specified in the aforementioned U.S. Pat. No. 3,272,118, the disclosure of which is hereby incorporated by reference, and the objects can be fed to the carrier 66 through an opening in the hopper 12 in a manner disclosed in said patent.

At the upper end of the hopper a fluid jet 97 is positioned to keep objects accumulated at the top of the hopper within the hopper confines.

With reference to FIGS. 1 and 2 of the drawings, there is shown print transfer roll 208 partially disposed in ink pot 228. The ink pot 228 is affixed to the side frame via flange 230. Affixed to the upper arm 192 of the bracket 188 is an auxiliary bracket 231 mounting a shaft 233 which extends through the ink pot 228 and mounts at the upper end thereof a doctor blade 235 adapted for engagement with the face of the transfer roll 208. Also secured to the ink pot, as by bracket 237, is a doctor blade 239 also adapted for engagement with the face of the transfer roll 208.

The transfer roll 208 is the same diameter as the offset printing roll 218 and in practice has etched into or otherwise formed on its face, the indicia, characters or inscriptions with which the articles are to be marked.

The various mechanisms utilized to drive the sprockets 34, 40 and transfer and printing rolls 208, 218 do not constitute a material part of the present invention. Suitable drive and clutch mechanisms to activate and deactivate the drive for the chains 44 and 46 and the printing rolls are thoroughly detailed in the aforementioned U.S. Pat. No. 3,272,118.

With regard to the present invention, it is sufficient to point out that an electric motor 234 (FIG. 2) actuates a speed reducer 236, the output shaft 238 of which carries sprocket 240. Sprocket 240, in turn, drives a chain 242 trained thereon and actuates sprocket 244 (FIG. 1). The chain 242 is trained over sprocket 248 (see FIG. 2) that is mounted on shaft 182. Internal linkage members as described in the aforementioned U.S. Pat. No. 3,272,118 transmit drive from the sprocket 248 through chain 266 that is trained about another sprocket 264 (FIG. 1) in a manner well known per se, associated with a clutch as described in the aforementioned patent, and accordingly not illustrated in the drawings, to selectively activate and deactivate driving motion of the sprockets 40 and 34 to move the endless conveyor along the inclined run.

Commonly mounted with sprocket 248 on shaft 182 is a bevel gear 186 (FIG. 1) that meshes with bevel gear 200 turning shaft 198 and thus driving spur gear 202 mounted on shaft 198. Gear 202 actuates gear 216, and through the latter gear, shaft 214 in the printing roll 218. The face of the printing roll 218 being in frictional contact with the face of the transfer roll 208 turns the latter and shaft 204 disposed in the tubular shaft 198. The lowermost side of the transfer roll 208 dips into the printing fluid 232, and as the inked rim portion rises from the ink pot the doctor blades 235 and 239 wipe the face of the transfer roll clean, except for the ink which is retained in the depression 210, which ink is transferred to and marks the printing roll 218. The locations of these marks across the face of the printing roll may be varied by manipulating the screw 226 to raise or lower the transfer roll 208.

A container 16 (FIG. 1) is provided in the housing into which the objects are discharged via the aid of fluid jet 201 after they have completed their travel along the upper run of the conveyor 42.

In operation, of the form of the invention illustrated in FIGS. 1–9, the objects 93 are fed from the hopper 12 and are received in the pockets 73 of the carriers 56 as the carriers pass beneath the hopper 12 at the beginning of their run up the conveyor 42.

The desired indicia are imprinted on the objects 93 via print roll 218. Since the peripheral speed of the print roll 218 is greater than the linear speed of the conveyor 42, the objects 93 are spun around their axes and the "wrap around" printing operation is effected.

Due to the provision of the aligned relief portions 81, 83, 95 about pocket 73 and guide 79, the ink is not smeared as the object 93 is spun and transported along the conveyor 42 after printing.

After each object 93 passes the guide 79 downstream from the printing station, it is easily released as the beveled walls 75, 77 and jet 201 cooperate to blow the objects out of the pockets 73 into the container 16.

With reference to FIGS. 9 through 12, there is shown a specific embodiment providing an improved means for printing along one or both of the generally planar side portions of a tablet 300. In FIG. 9, printing rolls 302, 304 are disposed along opposite sides of the conveyor, generally designated as 42. The print rolls 302, 304 are rotatably mounted on shafts 308, 310 as fully explained in aforementioned U.S. Pat. No. 3,272,118.

The tablets 300 are seated within carriers 320 that are carried by the conveyor. As best seen in FIGS. 11 and 12, the generally planar sides 322, 324 of the tablet 300 protrude from the corresponding carrier sides.

A pair of guides 326, 328 are disposed on opposite sides of the conveyor 306; the guides are mounted to their respective side frames of the housing in a similar fashion to the mount of guide 79 to frame 20 (see FIG. 4). Each guide 326 and 328 includes a groove 330, 332. These grooves are aligned and disposed in facing relation to each other and extend in a downstream direction from the print rolls 302, 304 to form a track 334 upon which the sides 322, 324 of tablet 300 ride as the carriers 320 transport the tablet along the upper run of the conveyor after printing.

Beveled windows, 336 and 338 are provided in the guides 326, 328 and the print rolls 302, 304 extend through the windows to print the desired indicia along the sides of the tablet.

In accordance with the form of the invention, illustrated in FIGS. 9–12, if printing on one side only of the tablet is desired, one guide 328 is not provided with a window 336 or 338 and of course, the only print roll is located on the side of the conveyor proximate the guide with a window.

As shown, the windows 336, 338 are formed with beveled, gently sloping walls 340, 342 so as to allow easy entrance of the printing roll therein without degradation of the printing roll.

It should be understood that the form of the invention depicted in FIGS. 9 through 12 is suitable for use in conjunction with the apparatus shown in FIGS. 1 and 2 of the drawings. In this case, the surface speed of the print rolls 302, 304 is adjusted to equal the linear speed of the conveyor 306. Accordingly, there is provided a means for reliably guiding tablets, pills and the like along the upper conveyor run. Further, the provision of grooves 330, 332 insures that the indicia printed on the sides 322, 324 are not smeared as the tablet 300 is transported after printing.

Although this invention has been described in conjunction with certain specific forms and certain modifications thereof, it will be appreciated that a wide variety of other modifications can be made without departing from the spirit of the invention.

We claim:

1. In apparatus for printing objects that are all similar in size and shape, which apparatus includes a conveyor for transporting said objects along a predetermined path, hopper means located at an upstream location of said conveyor and including a discharge which feeds said conveyor, the improvement which comprises the combination of carrier means on said conveyor having pocket means therein arranged to receive objects fed thereto, means operable for printing upon said objects as they are advanced by said conveyor, including a guide member stationarily mounted and extending along one side of said conveyor proximate said carrier means, said guide member having a recessed area thereof that extends in the direction of said predetermined path, means for operating said printing means at a surface speed in excess of the linear speed of said conveyor thereby to rotate each said object as it is being printed, and means for ejecting said objects from said carriers downstream from said printing means, said pocket means comprising a pair of upstanding wall members defining beveled surfaces to facilitate in ejection of said objects therefrom, each wall being provided with a recessed relief portion aligned with said guide member recessed area and extending about said pocket and spacing a portion of said pocket from said object so that indicia printed on the object in the area proximate said relief area are not smeared on said pocket or said guide member during printing.

2. Improved apparatus as recited in claim 1 wherein said ejection means comprise fluid jet means downstream from said guide member directed against the side of said carrier remote from said guide member.

3. Apparatus for printing upon an object such as a tablet, pill or the like having two substantially planar side portions, said objects being similar in size and shape, said apparatus comprising a conveyor connected for transporting the objects along a predetermined path, hopper means located at an upstream location of said conveyor and including a discharge opening in the bottom thereof directly over said conveyor and through which said objects are fed to said conveyor, carrier means positioned on said conveyor in a position to receive and transport said objects along said path, printing means operable for printing upon said objects as they are advanced by and carried away from said hopper means by said conveyor, a pair of guide bars extending along opposed sides of said conveyor proximate said carrier means, each said guide bar having a groove therein, said grooves being substantially aligned with and facing each other and extending along the transport direction downstream from said printing means to provide a track upon which the respective sides of said object are transported, at least one of said guide bars being provided with a window means therein through which said printing means extends to imprint the desired indicia on said object, means for operating said printing means at a surface speed substantially equal to the linear speed of said conveyor, and means for ejecting said objects from said carriers downstream from said printing means.

4. Apparatus as recited in claim 3 wherein said printing means includes a pair of print rollers, said print rollers being disposed along opposite sides of said conveyor, and wherein both said guide bars include window means therein, each of said print rolls extending through one of said window means so that the desired indicia are imprinted along both sides of said object.

5. Apparatus as recited in claim 3 wherein said window means comprise beveled cut out portions of one of said guide bars.

* * * * *